United States Patent [19]

Gardner

[11] 3,936,669

[45] Feb. 3, 1976

[54] BEAUTY SWAG LAMP

[75] Inventor: Ruth E. Gardner, Des Moines, Iowa

[73] Assignees: Marton C. Gaston; Joan C. Gaston, both of Booneville, Iowa ; part interest to each

[22] Filed: July 11, 1974

[21] Appl. No.: 487,552

[52] U.S. Cl. ..... 240/4.2; 240/4.1; 240/6.45 R; 240/78 LE

[51] Int. Cl.[2] ..... F21V 33/00

[58] Field of Search .... 240/4.1, 4.2, 6.45 R, 6.45 P, 240/78 LE, 6.4 R, 4

[56] References Cited

UNITED STATES PATENTS

| | | | |
|---|---|---|---|
| 1,405,532 | 2/1922 | Marko | 240/6.45 R |
| 1,980,351 | 11/1934 | Osterman | 240/6.45 R |
| 2,092,355 | 9/1937 | Mailloux | 240/6.45 R |
| 2,201,251 | 5/1940 | Van Patten | 240/4.2 |
| 2,302,043 | 11/1942 | Matway | 240/6.45 R |
| 2,454,527 | 11/1948 | Laschereau | 240/6.45 R |
| 3,596,085 | 7/1971 | Hansen | 240/78 LE X |
| 3,808,416 | 4/1974 | Pottratz | 240/6.45 R X |

*Primary Examiner*—Robert P. Greiner
*Assistant Examiner*—E. M. O'Connor
*Attorney, Agent, or Firm*—Zarley, McKee, Thomte & Voorhees

[57] ABSTRACT

A beauty swag lamp comprised of a frame having a top, bottom, and at least one side wall. The frame also has at least one movable door wall. The frame forms a compartment and at least one mirror is within the compartment. When the door wall is open the interior compartment and mirror are exposed for use. A light means is positioned within at least one wall to emit light outwardly from the frame when the door wall is closed.

8 Claims, 6 Drawing Figures

BEAUTY SWAG LAMP

BACKGROUND OF THE INVENTION

Swag lamps are known. The term is generally used to refer to lamp structures which hang in a free swinging manner from a ceiling structure. While such lamps have gained some measure of popularity, one disadvantage they have is use of available room space merely to provide a light source. The light source could as well be directly attached to the ceiling leaving the room space for more efficient use. The swag lamp of this invention not only provides a light source but also includes a mirror which permits the user to view the back of the head, when used in conjunction with a stationary mirror, such as a medicine cabinet in a bathroom, or a vanity mirror in a dressing room, etc., and leaves both hands free to fix hair, comb, cut hair, etc. It also has an interior compartment with a light source, a work place and mirror, all specifically designed for use during application of make-up. Thus the available room space is used more efficiently.

Accordingly, it is an object of this invention to provide a new and improved swag lamp.

A further object of this invention is to provide a swag lamp, having an interior compartment designed such that the lamp will function to provide a view of the back of the head, leaving both hands free to work on the hair, and as a beauty table providing a work area for make-up, including mirror, a work area for beauty aids and a light for make-up purposes.

A still further object of the invention is to provide a swag lamp which makes more efficient use of the room space occupied by the lamp, and which is aesthetically attractive.

DETAILED DESCRIPTION OF THE INVENTION

Figure 1:
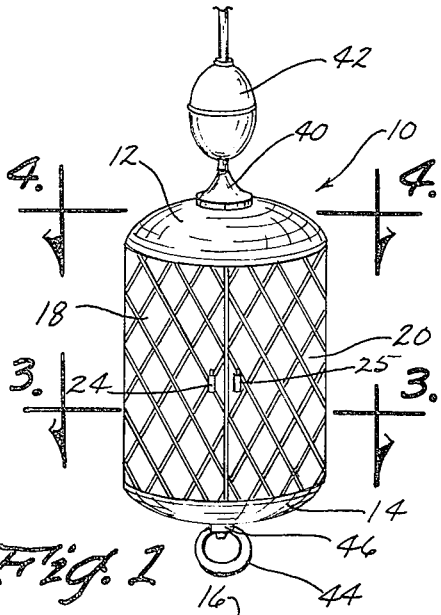
FIG. 1 is a perspective view of the lamp with the door wall in a closed position.
Figure 2:
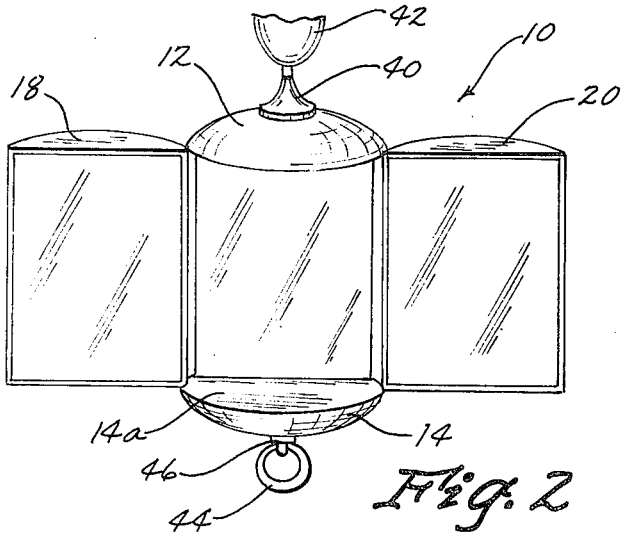
FIG. 2 is a view similar to FIG. 1, with the door wall in open position.
Figure 3:
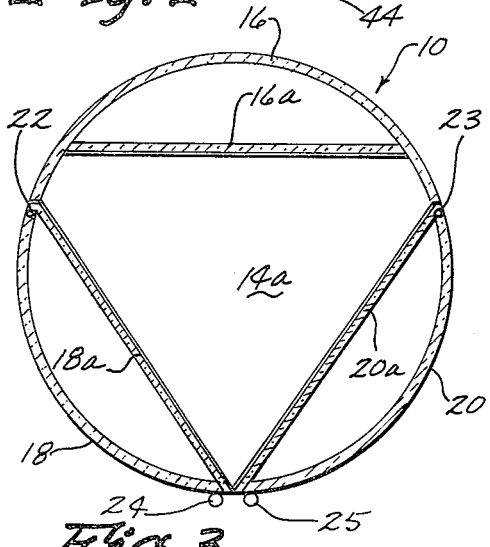
FIG. 3 is a sectional view of the lamp of FIG. 1 along line 3—3 of FIG. 1 showing the construction and position of the inner and outer walls.
Figure 5:
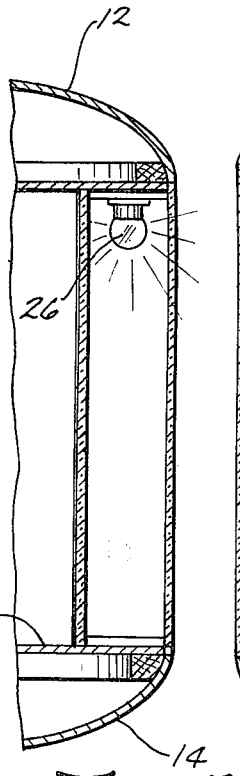
FIG. 5 is a partial section of FIG. 4 along line 5—5 showing the longitudinal section of one inner and outer wall and the position of a light with respect thereto.
Figure 6:
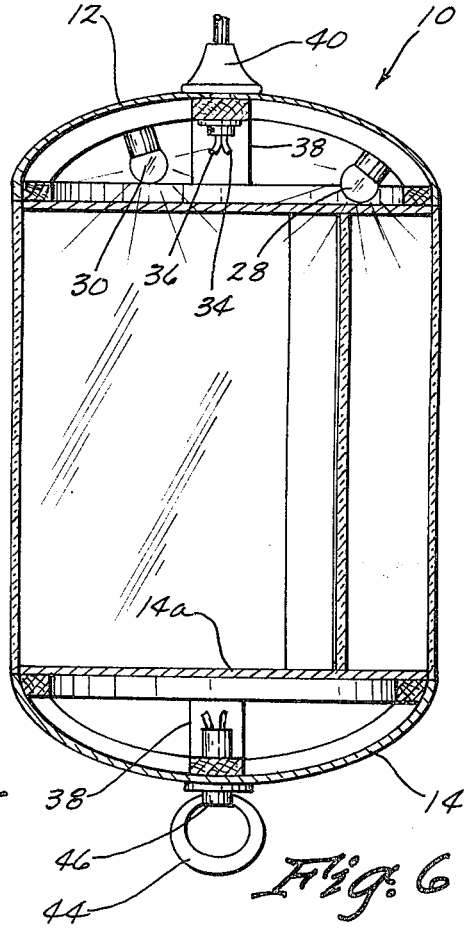
FIG. 6 is a longitudinal section along line 6—6 of FIG. 4 showing the construction of the interior compartment.
Figure 4:
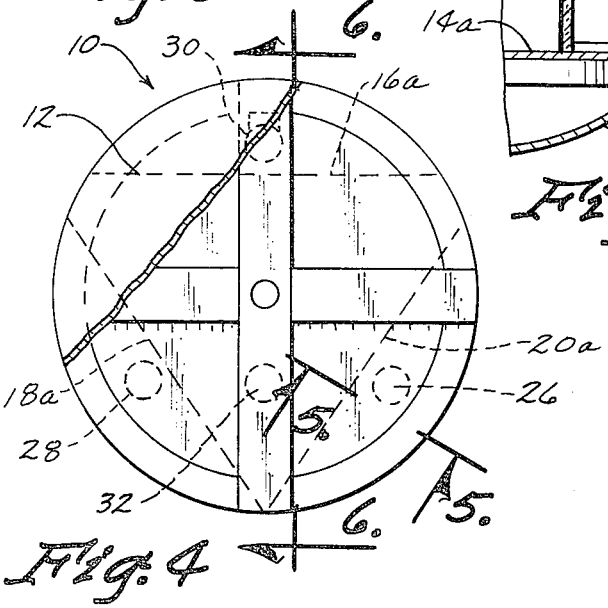
FIG. 4 is a sectional view of FIG. 1 along line 4—4 of FIG. 1 showing further details of the interior construction including the position of the lights with respect to the inner and outer walls.

The swag lamp 10 is comprised of a top wall 12, a bottom wall 14, an upstanding wall 16 extending between the top wall 12 and the bottom wall 14, and two door walls, 18 and 20, which also extend from top wall 12 to bottom wall 14. Door walls 18 and 20 are hingedly connected at 22 and 23 to upstanding wall 16 for swinging movement about a vertical axis to move door walls 18 and 20 from closed to open positions, as shown in FIGS. 1 and 2. When in closed position the door walls 18 and 20, upstanding wall 16 and top and bottom walls 12 and 14, define an interior enclosed compartment. Access to the compartment is provided by grasping door wall latches on knobs 24 and 25 and swinging the door walls open. Each of upstanding walls 16, and door walls 18 and 20, are preferably comprised of an inner panel designated by the letter *a*. The outer panel is comprised of material adapted to let light pass therethrough. Inner panels 16*a*, 18*a* and 20*a* are inwardly presented mirrors such that upon opening of door walls 18 and 20, the mirror surface of all three inner panels is exposed for use.

Lights 26, 28 and 30 are positioned between inner panels 20*a*, 18*a*, and 16*a*, respectively, and provide light through the outer panels 20, 18 and 16 to the room in which the lamp is positioned. Preferably, an additional light 32 is located on the interior surface of top wall 12 to emit light within the interior compartment whenever door walls 18 and 20 are in open position. The lamps are, of course, electrically connected through cords 34 and 36 in conventional fashion.

Door walls 18 and 20 and upstanding wall 16 may be of partially square, oval, diamond, octagon, hexagon, etc., shape so that the lamp itself is of general square, oval, diamond, octagon, hexagon, etc., shape when the door walls are in closed position.

Longitudinally extending conduit housing 38 extends from top wall 12 and bottom wall 14 to house in protective fashion the electrical cords 34 and 36. A lamp hanging support 40 is attached to conduit 38 by conventional means and is preferably length adjustable at 42 with respect to a ceiling to move the lamp to selected heights with respect to the ceiling and floor of a room. Bottom wall 14 has a grasping ring 44 for pulling the lamp 10 to adjust its height. An on-off switch of conventional construction is also provided at 46.

In a preferred embodiment the interiorly exposed surface 14*a* of bottom wall 14 is constructed to form an upwardly presented work surface for holding beauty aids and the like.

In actual operation the lamp is placed in a room and provides soft interior light when door walls 18 and 20 are closed. The light is softened by passing through the light emitting exterior or outer panels. When use as a beauty aid is desired, door walls 18 and 20 are opened and the mirror surface are available for use. Adequate light is provided by light 32 and a work space area is provided by surface 14*a* of bottom wall 14. Thus, as can be seen the invention accomplishes at least all of its stated objects.

What is claimed is:

1. A lamp comprising:

a lamp frame forming an enclosed compartment and comprising a top wall, a bottom wall, at least one upstanding wall and at least one door wall, said door wall and said upstanding wall each comprising spaced apart inner and outer panels, said outer panels being adapted to let light pass therethrough, at least one mirror within said compartment;

said door wall being movable from a closed position wherein said compartment and said mirror are hidden from view from outside said compartment to an open position wherein said compartment and said mirror are exposed to view;

light means comprising at least one light emitting device within the space between said inner and outer panels of each of said door and upstanding walls, said outer panels of said door and upstanding walls permitting light to pass outwardly from said light emitting devices.

2. A lamp according to claim 1 wherein said lamp frame comprises one upstanding wall and two door walls, said door walls each being hinged to said upstanding wall for swinging movement about a vertical axis.

3. A lamp according to claim 2 wherein each of said upstanding and door walls comprises spaced apart inner and outer panels, said inner panels comprising inwardly presented mirrors and said outer panels comprising material adapted to permit light to pass therethrough, light emitting devices being positioned within the space between said inner and outer panels.

4. A lamp according to claim 3 wherein a light emitting device is located on the under surface of said top wall for emitting light within said compartment whenever said doors walls are in said open position.

5. A lamp according to claim 4 wherein said bottom wall forms an upwardly presented work surface within said compartment.

6. A lamp according to claim 5 wherein supporting means is operatively attached to said lamp frame for supporting said frame at a predetermined height above the floor.

7. A lamp according to claim 6 wherein said supporting means comprises a flexible member operatively connected to said frame and adapted to suspend said frame from the ceiling of a room.

8. A lamp according to claim 7 wherein said lamp frame has a substantially cylindrical shape when said door walls are in said closed position.

* * * * *